US011524498B2

(12) United States Patent
Anderson et al.

(10) Patent No.: US 11,524,498 B2
(45) **Date of Patent: *Dec. 13, 2022**

(54) DECODERS TO ACTIVATE FLUIDIC ACTUATORS FOR SENSE MEASUREMENTS

(71) Applicant: HEWLETT-PACKARD DEVELOPMENT COMPANY, L.P., Spring, TX (US)

(72) Inventors: Daryl E. Anderson, Corvallis, OR (US); Eric T. Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 15 days.

This patent is subject to a terminal disclaimer.

(21) Appl. No.: 16/500,421

(22) PCT Filed: Apr. 6, 2018

(86) PCT No.: PCT/US2018/026543
§ 371 (c)(1),
(2) Date: Oct. 3, 2019

(87) PCT Pub. No.: WO2019/194829
PCT Pub. Date: Oct. 10, 2019

(65) Prior Publication Data

US 2022/0001667 A1 Jan. 6, 2022

(51) Int. Cl.
*B41J 2/14* (2006.01)
*B41J 2/045* (2006.01)

(52) U.S. Cl.
CPC ..... *B41J 2/14072* (2013.01); *B41J 2/0451* (2013.01); *B41J 2/04541* (2013.01); *B41J 2/04598* (2013.01); *B41J 2002/14354* (2013.01)

(58) Field of Classification Search
CPC ..... B41J 2/175; B41J 2/125; B41J 13/009
See application file for complete search history.

(56) References Cited

U.S. PATENT DOCUMENTS 6,130,683 A 10/2000 Ju
6,257,694 B1 7/2001 Tokumaru et al.
6,582,044 B2 6/2003 Su et al.
(Continued)

FOREIGN PATENT DOCUMENTS

EP 1413435 A1 4/2004
WO WO2013158105 A1 10/2013

OTHER PUBLICATIONS

Anderson et al., International Appl. No. PCT/US2018/026546 entitled Fluidic Actuator Activations for Sense Measurements filed Apr. 6, 2018 (40 pages).
(Continued)

*Primary Examiner* — Lam S Nguyen
(74) *Attorney, Agent, or Firm* — Trop Pruner & Hu PC

(57) ABSTRACT

In some examples, a fluid dispensing device includes a plurality of fluidic actuators and a decoder to detect that a first fluidic actuator is to be activated, and detect that a sense measurement is to be performed. In response to detecting that the first fluidic actuator is to be activated and the sense measurement is to be performed, the decoder is to suppress activation of the first fluidic actuator at a first time, and activate the first fluidic actuator at a second time corresponding to a sense measurement interval to perform the sense measurement of the first fluidic actuator.

15 Claims, 9 Drawing Sheets

(56) References Cited

U.S. PATENT DOCUMENTS

| | | | |
|---|---|---|---|
| 6,616,256 | B1 | 9/2003 | Cook et al. |
| 6,698,862 | B1 | 3/2004 | Choi et al. |
| 7,635,174 | B2 | 12/2009 | Bergstedt et al. |
| 8,708,449 | B2 | 4/2014 | Shinkawa |
| 8,899,711 | B2 | 12/2014 | Masuda et al. |
| 9,493,002 | B2 | 11/2016 | Edelen et al. |
| 9,776,395 | B2 | 10/2017 | Anderson et al. |
| 2006/0125858 | A1 | 6/2006 | Silverbrook et al. |
| 2008/0084444 | A1 | 4/2008 | Sheahan et al. |
| 2010/0231625 | A1 | 9/2010 | Walmsley et al. |
| 2011/0084997 | A1 | 4/2011 | Chen et al. |
| 2013/0278656 | A1 | 10/2013 | Govyadinov et al. |
| 2013/0278657 | A1 | 10/2013 | Martin et al. |
| 2014/0210881 | A1 | 7/2014 | Van Brocklin et al. |
| 2016/0271940 | A1 | 9/2016 | Martin et al. |
| 2017/0225455 | A1 | 8/2017 | Veenstra et al. |

OTHER PUBLICATIONS

Anderson et al., International Appl.No. PCT/US2018/026548 entitled Sense Measurements Indicators to Select Fluidic Actuators for Sense Measurements filed Apr. 6, 2018 (68 pages).

Martin et al., International Appl. No. PCT/US2018/026541 entitled Sense Measurements for Fluidic Actuators filed Apr. 6, 2018 (33 pages).

Martin et al., International Appl. No. PCT/US2018/026552 entitled Reference Measurements of Fluidic Actuators filed Apr. 6, 2018 (47 pages).

DECODERS TO ACTIVATE FLUIDIC ACTUATORS FOR SENSE MEASUREMENTS

BACKGROUND

A fluid dispensing system can dispense fluid towards a target. In some examples, a fluid dispensing system can include a printing system, such as a two-dimensional (2D) printing system or a three-dimensional (3D) printing system. A printing system can include printhead devices that include fluidic actuators to cause dispensing of printing fluids.

BRIEF DESCRIPTION OF THE DRAWINGS

Some implementations of the present disclosure are described with respect to the following figures.

Figure 1:
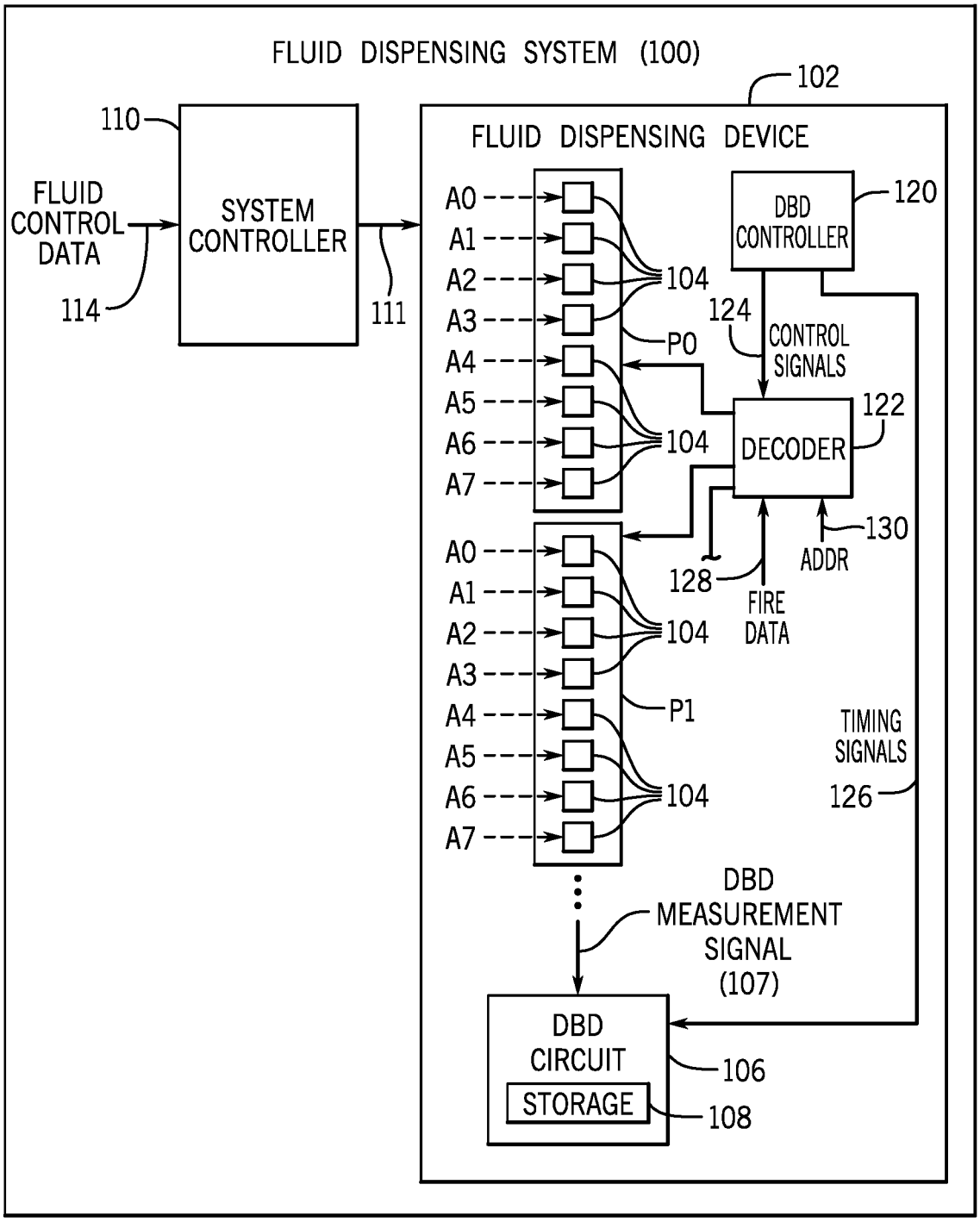
FIG. 1 is a block diagram of a fluid dispensing system including a system controller and a fluid dispensing device according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid dispensing device can include fluidic actuators that when activated cause dispensing (e.g., ejection or other flow) of a fluid. For example, the dispensing of the fluid can include ejection of fluid droplets by activated fluidic actuators from respective nozzles of the fluid dispensing device. In other examples, an activated fluidic actuator (such as a pump) can cause fluid to flow through a fluid conduit or fluid chamber. Activating a fluidic actuator to dispense fluid can thus refer to activating the fluidic actuator to eject fluid from a nozzle or activating the fluidic actuator to cause a flow of fluid through a flow structure, such as a flow conduit, a fluid chamber, and so forth.

Generally, a fluidic actuator can be an ejecting-type fluidic actuator to cause ejection of a fluid, such as through an orifice of a nozzle, or a non-ejecting-type fluidic actuator to cause flow of a fluid.

Activating a fluidic actuator can also be referred to as firing the fluidic actuator. In some examples, the fluidic actuators include thermal-based fluidic actuators including heating elements, such as resistive heaters. When a heating element is activated, the heating element produces heat that can cause vaporization of a fluid to cause nucleation of a vapor bubble (e.g., a steam bubble) proximate the thermal-based fluidic actuator that in turn causes dispensing of a quantity of fluid, such as ejection from an orifice of a nozzle or flow through a fluid conduit or fluid chamber. In other examples, a fluidic actuator may be a piezoelectric membrane based fluidic actuator that when activated applies a mechanical force to dispense a quantity of fluid.

In examples where a fluid dispensing device includes nozzles, each nozzle includes a fluid chamber, also referred to as a firing chamber. In addition, a nozzle can include an orifice through which fluid is dispensed, a fluidic actuator, and a sensor. Each fluid chamber provides the fluid to be dispensed by the respective nozzle. Prior to a droplet release, the fluid in the fluid chamber is restrained from exiting the nozzle due to capillary forces and/or back-pressure acting on the fluid within the nozzle passage.

During a droplet release from a nozzle, the fluid within the fluid chamber is forced out of the nozzle by actively increasing the pressure within the fluid chamber. In some example fluid dispensing devices, a resistive heater positioned within the fluid chamber when activated vaporizes a small amount of at least one component of the fluid. In some cases, a major component of the fluid (such as liquid ink for printing systems or other types of fluids) is water, and the resistive heater vaporizes the water. The vaporized fluid component expands to form a gaseous drive bubble within the fluid chamber. This expansion exceeds a restraining force on the fluid within the fluid chamber enough to expel a quantity of fluid (a single fluid droplet or multiple fluid droplets) out of the nozzle. Generally, after the release of fluid droplet, the pressure in the fluid chamber drops below the strength of the restraining force and the remainder of the fluid is retained within the fluid chamber. Meanwhile, the drive bubble collapses and fluid from a reservoir for the fluid dispensing device flows into the fluid chamber to replenish the lost fluid volume resulting from the fluid droplet release. The foregoing process is repeated each time the nozzle of the fluid dispensing device is instructed to fire.

In other examples with non-ejecting fluidic actuators, the drive bubble formed by activation of a non-ejecting fluidic actuator causes movement of fluid through a fluid conduit or fluid chamber.

After repeated use of the fluidic actuators of a fluid dispensing device, the fluidic actuators or flow structures associated with the fluidic actuators may develop defects (e.g., a nozzle, fluid conduit, or fluid chamber may become clogged, a fluidic actuator may malfunction, etc.) and hence may not operate in a target manner. As a result, fluid dispensing performance of the fluidic actuators may degrade over time and use.

In some examples, fluidic actuator health can be determined by performing drive bubble detection (DBD) measurements for each fluidic actuator. DBD measurements can allow for detection of characteristics of a drive bubble and a fluid in a fluid chamber or fluid channel. From these characteristics, qualities of the drop ejected or fluid moved can be inferred, so that servicing or replacement of a degraded fluid dispensing device can be performed.

Although reference is made to DBD measurements in some examples, it is noted that techniques or mechanisms according to some implementations of the present disclosure can also be applied to other types of sense measurements of fluidic actuators. A sense measurement of a fluidic actuator refers to measuring a characteristic of the fluidic actuator and/or flow structure associated with the fluidic actuator for determining a condition of the fluidic actuator and/or flow structure.

A fire event can refer to a signal or other indication that is provided to activate a fluidic actuator. A fire event to activate a fluidic actuator can refer to a fire event to activate a single fluidic actuator or a group of fluidic actuators. In some examples, a DBD measurement for a fluidic actuator is performed in response to a fire event. In some cases, to obtain multiple DBD measurements for a fluidic actuator, the fluidic actuator can be fired multiple times in response to respective multiple fire events.

In some examples, activating a fluidic actuator to perform a DBD measurement can cause ejection of a fluid droplet from a corresponding nozzle or cause other dispensing of an amount of fluid, which can lead to increased fluid usage. Also, in printing applications, ejection of a fluid droplet during a sense measurement can lead to the fluid droplet being deposited onto a print medium or other print target, which may be undesirable since the fluid droplet can cause a noticeable artifact on the print medium or other print target.

In accordance with some implementations of the present disclosure, extra ejection or flow of fluid from nozzles or other flow structures subject to sense measurements (e.g., DBD measurements) can be suppressed by providing circuitry as part of a fluid dispensing device (e.g., a fluidic die) to detect that a given fluidic actuator is to be activated, detect that a sense measurement is to be performed, and in response to detecting that the given fluidic actuator is to be activated and the sense measurement is to be performed: suppress activation of the given fluidic actuator at a given time, and activate the given fluidic actuator at a different time corresponding to a sense measurement interval to perform the sense measurement of the given fluidic actuator.

FIG. 1 is a block diagram of a fluid dispensing system 100, according to some examples. The fluid dispending system 100 can be a printing system, such as a 2D printing system or a 3D printing system. In other examples, the fluid dispending system 100 can be a different type of fluid dispensing system. Examples of other types of fluid dispensing systems include those used in fluid sensing systems, medical systems, vehicles, fluid flow control systems, and so forth.

The fluid dispensing system 100 includes a fluid dispensing device 102 for dispensing fluid. In a 2D printing system, the fluid dispensing device 102 includes a printhead that ejects printing fluid (e.g., ink) onto a print medium, such as a paper medium, a plastic medium, and so forth.

In a 3D printing system, the fluid dispensing device 102 includes a printhead that can eject any of various different printing fluids onto a print target, where the printing fluids can include any or some combination of the following: ink, an agent used to fuse powders of a layer of build material, an agent to detail a layer of build material (such as by defining edges or shapes of the layer of build material), and so forth. In a 3D printing system, a 3D target is built by depositing successive layers of build material onto a build platform of the 3D printing system. Each layer of build material can be processed using the printing fluid from a printhead to form the desired shape, texture, and/or other characteristic of the layer of build material.

In some examples, the fluid dispensing device 102 can be a fluid dispensing die. A "die" refers to an assembly where various layers are formed onto a substrate to fabricate circuitry, fluid chambers, and fluid conduits.

The fluid dispensing device 102 includes an array of fluidic actuators 104. The array of fluidic actuators 104 can include a column of fluidic actuators, or multiple columns of fluidic actuators. The fluidic actuators 104 can be organized into multiple primitives, where each primitive includes a specified number of fluidic actuators. FIG. 1 shows primitives P0 and P1. Each primitive P0 or P1 includes 8 fluidic actuators. In other examples, a primitive can include a different number of fluidic actuators. Also, the array of fluidic actuators 104 can include more than two primitives.

The fluidic actuators 104 can be part of nozzles or can be associated with other types of flow structures, such as fluid conduits, fluid chambers, and so forth. Each fluidic actuator is selected by a respective different address. Thus, in the example of FIG. 1, the fluidic actuators in the nozzles of the primitive P0 are selected by respective addresses A0-A7, and similarly, the fluidic actuators in the nozzles of the primitive P1 are selected by respective addresses A0-A7.

In some examples, fluidic and electrical constraints can prevent firing of all of the fluidic actuators 104 simultaneously. To fire all the fluidic actuators, data (e.g., in the form of a first data packet) is loaded to activate all fluidic actuators in the primitives for a first address (e.g., A0), then data (e.g., in the form of a second data packet) is loaded to activate all fluidic actuators selected by a second address (e.g., A1), and so forth.

In some examples, fire data (also referred to as "activate data") to control activation or non-activation of a fluidic actuator in each primitive can be loaded in one of several ways. A first way is to load fire data (for activating a fluidic actuator) on a per-primitive basis, and a second way is to load fire data on a per-fluidic actuator basis. In some examples, loading the fire data on a per-primitive basis refers to loading fire data for each primitive and supplying an address for each primitive, where the fire data loaded for a respective primitive is used for activating just a single fluidic actuator of the respective primitive in each activation interval. More specifically, a unique fire data bit (or fire data bits) is loaded for each respective primitive, and a single address is supplied to groups of primitives. In each successive activation interval, fire data for a successively different fluidic actuator is loaded for each primitive. In some examples, the activation intervals are referred to as fire pulse groups (FPGs). A set of FPGs, including one FPG for each address, is referred to as a column group. The fire data loaded in each FPG (or more generally, each activation interval) can be in the form of a data packet.

More generally, a column group is referred to as a group of activation intervals or cycles that correspond to different addresses (e.g., A0-A7). In the example of FIG. 1, the 8 fluidic actuators of each primitive can be activated in the respective 8 FPGs of a column group (or more generally, the respective 8 activation intervals of a group of activation intervals).

In some examples, the loading of fire data on a per-primitive basis is performed in a fluid dispensing device that has an FPG arrangement, i.e., an arrangement where for each primitive, successive fluidic actuators of a primitive are activated in respective activation intervals with fire data loaded in each respective activation interval.

As noted above, another way of loading fire data is to load fire data on a per-fluidic actuator basis. In some examples, loading fire data on a per-fluidic actuator basis is performed for a fluid dispensing device that has a full column buffer (FCB) arrangement. In the FCB arrangement, fire data is loaded for all fluidic actuators in an array of fluidic actuators (e.g., column of fluidic actuators). As a result, fire data does not have to be loaded on each successive activation interval of multiple activation intervals for activating fluidic actuators of a primitive. Rather, since the fire data has been loaded for all fluidic actuators of the array of fluidic actuators, such loaded fire data for the individual fluidic actuators can be used to control activation of respective fluidic actuators. Once fire data has been loaded for all fluidic actuators, fire pulses and address data are provided to all primitives (i.e., for an 8-address primitive, 8 fire pulses, each with a unique address, are sent before the next FCB data packet is loaded).

In accordance with some implementations of the present disclosure, as shown in FIG. 1, the fluid dispensing device 102 further includes a DBD controller 120 and a decoder 122 that is used to control activation of fluidic actuators 104, where the activation of a fluid actuator can be a normal activation of the fluid actuator or a sense measurement activation of the fluid actuator to perform a sense measurement.

As used here, a "controller" can refer to a hardware processing circuit or a combination of a hardware processing circuit and machine-readable instructions executable on the hardware processing circuit. A hardware processing circuit can include any or some combination of the following: a microprocessor, a core of a multi-core microprocessor, a microcontroller, a programmable integrated circuit, a programmable gate array, or another hardware processing circuit.

The decoder 122 can also refer to a hardware processing circuit or a combination of a hardware processing circuit and machine-readable instructions executable on the hardware processing circuit.

A "normal activation" of a fluidic actuator refers to activating the fluidic actuator in a scheduled activation interval, as scheduled by a system controller 110 of the fluid dispensing system 100. A "sense measurement" activation of a fluidic actuator refers to activating the fluidic actuator in a sense measurement interval that is shifted in time from a scheduled activation interval (also referred to as a "normal activation interval").

The DBD controller 120 provides control signals 124 to control the operation of the decoder 122. Further details regarding the control signals 124 are provided below. The DBD controller 120 also provides timing signals 126 to a DBD circuit 106.

The DBD circuit 106 can receive a DBD measurement signal 107 output by a sensor (that is associated with an activated fluidic actuator) of a nozzle (or other flow structure) that is subjected to a DBD measurement. In examples where the fluid dispensing device 102 includes nozzles, the nozzles can include respective sensors. In other examples, the sensors can be included in other flow structures through which fluid can be dispensed by activations of respective fluidic actuators.

A sensor includes a fluid property sensor to measure a fluid property of the nozzle or other flow structure. The sensor can measure a fluid property concurrent with activation of an associated fluidic actuator. In examples where a fluidic actuator is a thermal based fluidic actuator, the sensor can be used (via sense circuits) to sense a fluid property during formation and collapse of a vapor bubble.

In other examples where the fluidic actuator is a piezoelectric membrane based fluidic actuator, the sensor may be used (via sense circuits) to sense a fluid property during actuation of the piezoelectric membrane that causes ejection or other movement of a quantity of fluid.

In some examples, a sensor can include an impedance sensor to measure variations in the impedance associated with a nozzle or other flow structure due to formation of a drive bubble. In other examples, other types of sensors can be used to measure characteristics of the nozzle or other flow structure due to formation of a drive bubble.

In an example, if a first fluidic actuator of the primitive P0 (which can be any of the fluidic actuators selected by addresses A0-A7) is the subject of a DBD measurement, then the DBD circuit 106 receives the DBD measurement signal 107 from the sensor associated with the first fluidic actuator of the primitive P0. Similarly, if a second fluidic actuator of the primitive P1 (which can be any of the fluidic actuators selected by addresses A0-A7) is the subject of a DBD measurement, then the DBD circuit 106 receives the DBD measurement signal 107 from the sensor associated with the second fluidic actuator in the primitive P1.

In some examples, just one fluidic actuator is selected per array of fluidic actuators 104 for performing a DBD measurement. In other examples, more than one fluidic actuator can be selected for DBD measurement in an array of fluidic actuators 104.

The DBD circuit 106 includes a storage 108 to store a value corresponding to the DBD measurement signal 107 received from the sensor associated with the fluidic actuator that is subject to the DBD measurement. The storage 108 can be a memory, a storage capacitor, a latch, a register, or any other type of storage element.

The storage 108 can store an analog signal corresponding to the DBD measurement signal 107, or a digital value based on the DBD measurement signal 107. To produce a digital value, for example, the DBD circuit 106 can include a comparator (not shown) to compare the DBD measurement signal 107 from a sensor of a nozzle that is the subject of a DBD measurement, to a specified threshold. The output of the comparator can then be provided to an analog-to-digital (ADC) converter to convert into a digital value that can be stored in the storage 108. In other examples, other ways of producing a digital value based on the DBD measurement signal 107 can be performed.

The timing at which the DBD measurement signal 106 is processed and stored by the DBD circuit 106 is controlled by the timing signals 126 from the DBD controller 120.

The fluid dispensing system 100 also includes the system controller 110 (which is separate from the fluid dispensing device 102) that can control the operation of the fluidic actuators 104 of the fluid dispensing device 102.

The system controller 110 receives fluid control data 114, which controls (schedules) which of the fluidic actuators of the array of fluidic actuators 104 of the fluid dispensing device 102 are to be activated (and which other fluidic actuators are to remain inactive). In a printing system, the fluid control data 114 includes image data that schedules the dispensing of fluid from nozzles in forming an image on a print medium (for 2D printing) or in forming a 3D object (for 3D printing) during a print operation. Alternatively, the fluid control data 114 can schedule the activation of pumps or other fluidic actuators to cause flow of a fluid, such as to distribute pigment particles and so forth.

The system controller 110 provides controller activation data 111 (which may include fire data and address data, among other things like DBD control data) to the fluid dispensing device 102. A data controller (not shown) on the fluid dispensing device 102 processes the received controller activation data 111 and extracts fire data 128 and address signals 130 that are provided to various groups of primitives, to select and control activation of the fluidic actuators 104 in respective activation intervals. In addition, the DBD controller 120 can extract sense measurement select data (e.g., DBD select data) from the DBD control data in the controller activation data 111.

Figure 2:
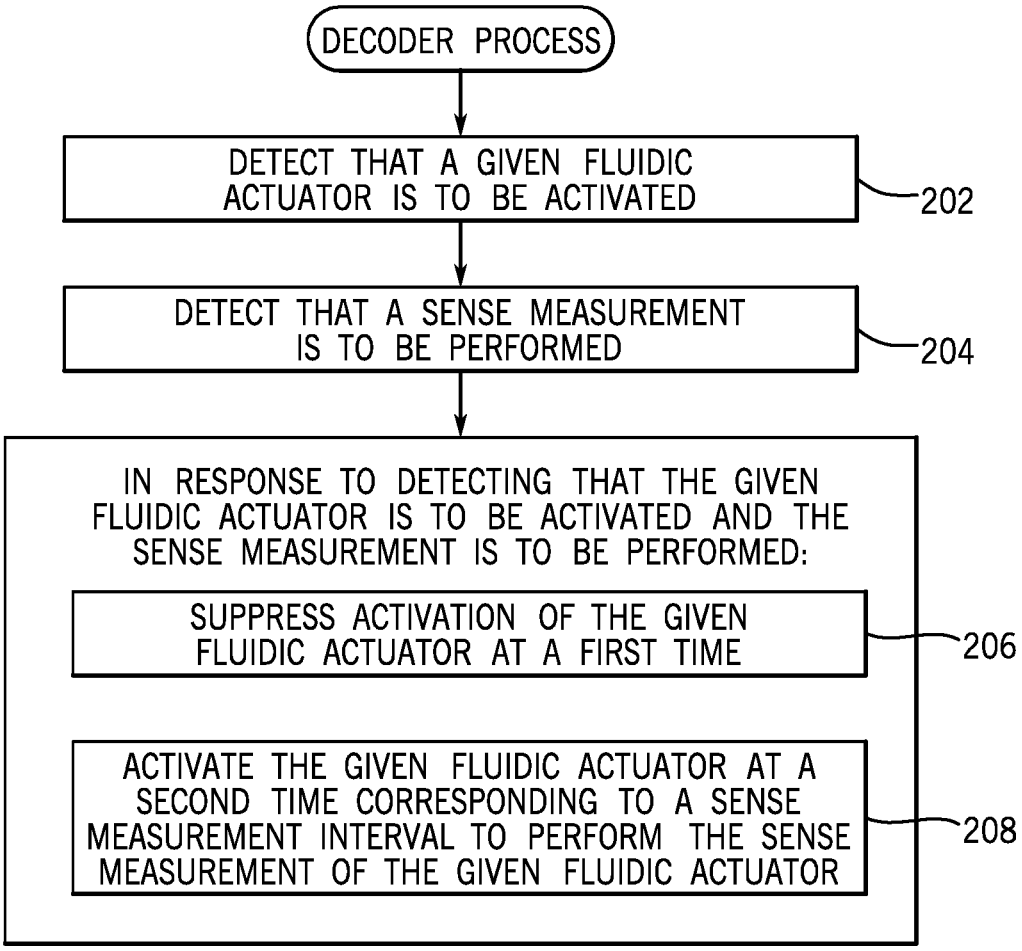
FIG. 2 is a flow diagram of a process of a decoder according to some examples.

FIG. 2 is a flow diagram of a process performed by the decoder 122 of the fluid dispensing device 102 according to some examples. The decoder 122 detects (at 202) that a given fluidic actuator is to be activated. This detection can be based on the fire data 128.

The decoder 122 detects (at 204) that a sense measurement is to be performed. This detection can be based on sense measurement select data that is part of the control signals 124 from the DBD controller 120 of the fluid dispensing device 102.

In response to detecting that the given fluidic actuator is to be activated and the sense measurement is to be performed, the decoder 122 suppresses (at 206) activation of the given fluidic actuator at a first time, and activates (at 208) the given fluidic actuator at a second time corresponding to a sense measurement interval to perform the sense measurement of the given fluidic actuator.

Figure 3:
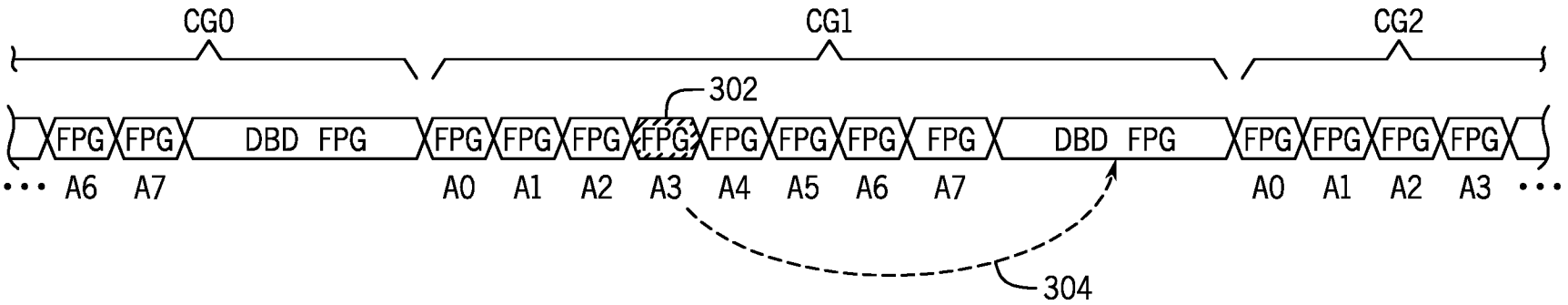
FIG. 3 is a timing diagram illustrating groups of activation intervals, with each group of activation intervals including a sense measurement interval according some examples.

FIG. 3 is a timing diagram that shows multiple column groups CG0, CG1, and CG2. As noted above, each column group includes a sequence of FPGs (assuming that the fluid dispensing device 102 has an FPG arrangement). The sequence of FPGs in a column group includes multiple FPGs that corresponding to respective addresses A0-A7. Such FPGs can be referred to as "normal FPGs" since respective fluidic actuators are selected for activation based on the fluid control data 114 in these FPGs. The series of FPGs in each column group further includes a DBD FPG, which is used to activate a fluidic actuator that is the subject of a DBD measurement. The DBD FPG is an extra FPG added to a column group in addition to the normal FPGs that correspond to addresses A0-A7.

If the fluid dispensing device 102 has an FCB arrangement, then the timing diagram of FIG. 3 can be modified to show each column group as having a sequence of activation intervals.

For the column group CG1, 8 normal FPGs are used to activate 8 respective fluidic actuators of a respective primitive (e.g., primitive P1 in FIG. 1) using respective different addresses A0-A7 (assuming the fluid control data 114 specifies that the fluidic actuators of CG1 are to be activated). The column group CG1 further includes a DBD FPG at the end of the 8 normal FPGs.

Primitive data (also referred to as "fire data") to control activation or non-activation of fluidic actuators is provided in each FPG to each primitive of the multiple primitives. The address sent with a FPG determines which fluidic actuator in each primitive is conditionally fired depending on the state of that primitive's fire data. So if, for example, the fluid control data 114 specifies that the fluidic actuator corresponding to address A3 in primitive P2 is to be fired, then during FPG 302 (corresponding to address A3), the fire data for primitive P2 is set active to enable activation of the fluidic actuator corresponding to address A3 in primitive P2.

Generally, a fluidic actuator activates if a) the fluidic actuator's fire data is set active, and b) if the current address matches that of the fluidic actuator's assigned address. A given fluidic actuator in a particular primitive is not activated, if in a current FPG of a column group, either the fire data for the particular primitive is set inactive or a current address for the current FPG does not match the address of the given fluidic actuator.

Although FIG. 3 shows a DBD FPG as having a length larger than that of a normal FPG, it is noted that the longer depicted length of the DBD FPG is used to represent the fact that a DBD measurement process activates a fluidic actuator, waits a specified amount of time, and samples a measurement signal from the sensor associated with the fluidic actuator. In actuality, the DBD FPG may have a time length that is the same as or similar to the time length of a normal FPG.

In the example of FIG. 3, it is assumed that the fluid control data 114 has selected a fluidic actuator in a particular primitive (hereinafter referred to as the "selected fluidic actuator") corresponding to normal FPG 302 (address A3) in the column group CG1 for activation, and further, that the DBD controller 120 has decided (such as in response to a command from the system controller 110) to perform a DBD measurement of the selected fluidic actuator in the column group CG1. This selected fluidic actuator is also referred to as the A3 selected fluidic actuator, since the fluidic actuator is in the particular primitive (fire data for the particular primitive is set active) and is to be activated by address A3 in the corresponding normal FPG 302.

In a normal operation (i.e., an operation where DBD measurement is not being performed for the column group CG1), the A3 selected fluidic actuator in the column group CG1 would be actuated in the normal FPG 302. However, in accordance with some implementations of the present disclosure, instead of activating the A3 selected fluidic actuator in the normal FPG 302, the selected fluidic actuator is instead activated in the DBD FPG of the column group CG1 to perform a DBD measurement. Effectively, the activation of the selected fluidic actuator has been time shifted (as indicated by 304) from the normal FPG 302 (which is the FPG when the selected fluidic actuator would normally be activated) to the DBD FPG of the column group CG1.

The shifting (304) of the activation of the selected fluidic actuator is performed by a) suppressing activation of the selected fluidic actuator in the normal FPG 302, which is accomplished by the decoder 122 disabling fluidic actuator in the normal FPG 302 (described in further detail in connection with FIG. 4 below), and b) the decoder 122 enabling activation of the selected fluidic actuator in the DBD FPG of the column group CG1 (described in further detail in connection with FIG. 4 below).

In FIG. 3, the shifting (304) of the activation of the selected fluidic actuator for the DBD measurement delays the activation of the selected fluidic actuator. In other examples, if the DBD FPG is placed earlier in the series of FPGs of the column group CG1 than the normal FPG 302, then the shifting (304) causes an earlier activation of the selected fluidic actuator to perform the DBD measurement.

In accordance with some implementations of the present disclosure, a selected fluidic actuator that is to be subject to a DBD measurement is chosen to be one that is already scheduled to fire in one of the normal FPGs corresponding to addresses A0-A7. However, by shifting the activation of the selected fluidic actuator, the selected fluidic actuator is not activated in the corresponding normal FPG, but instead is re-scheduled to be activated in the DBD FPG. Note that the selected fluidic actuator is still activated in the same column group that the selected fluidic actuator is set to be fired based on the fluid control data 114. The activation of the selected fluidic actuator is merely shifted by some amount of time relative to when the selected fluidic actuator was originally scheduled to be activated.

Figure 4:
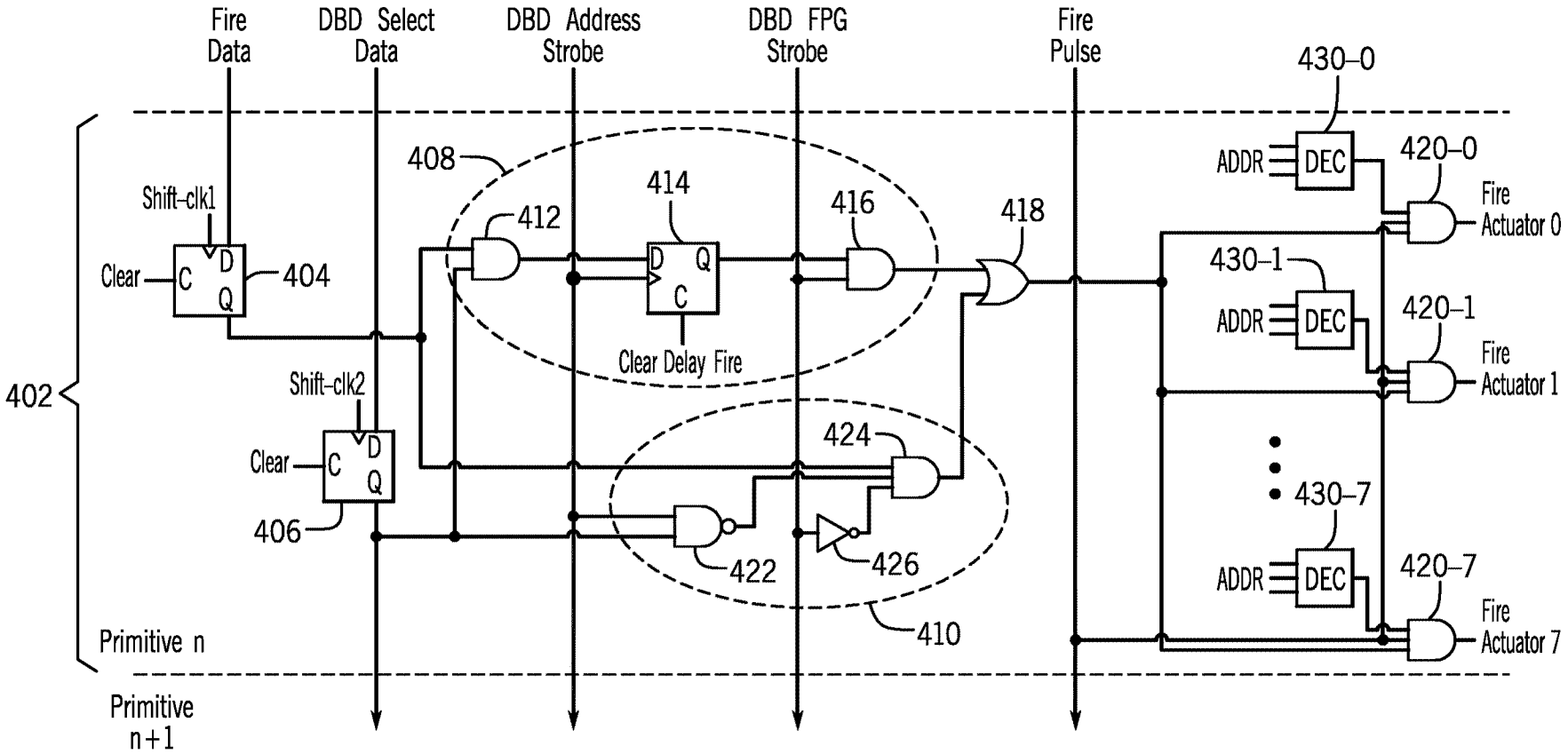
FIG. 4 is a schematic diagram of a decoder according to further examples.

FIG. 4 is a block diagram of components of an example of the decoder 122. The decoder 122 shown in FIG. 4 is for a fluid dispensing device 102 that is according to the FPG arrangement noted above. Although specific gates (in the form of AND, OR, and NAND gates, inverters, and flip-flops) are shown implementing the decoder 122, it is noted that in other examples, similar logic can be implemented with other types of circuitry, such as an ASIC, PGA, and so forth. More generally, a "logic gate" as used herein can refer to an individual gate (e.g., an AND gate, an OR gate, an inverter, a NAND gate, etc.) or a combination of gates or any other circuitry used to implement a logic functionality.

A portion 402 of the decoder 122 controls activation of fluidic actuators of an individual primitive (primitive n) of the fluid dispensing device 102. The same decoder portion 402 is repeated for each of the other primitives of the fluid dispensing device 102.

The decoder portion 402 includes a storage element 404 to store the fire data for a fluidic actuator of primitive n. In some examples, the storage element 404 can be in the form of a flip-flop (referred to as a "fire data flip-flop"), which stores data received at the D input on a transition of a clock (Shift-Clk1) that is provided to a clock input of the fire data flip-flop 404. A Clear signal is connected to a C input of the fire data flip-flop 404, and is used to clear the flip-flop 404 to an initial state (e.g., 0), and the output of the flip-flop 404 is represented as a Q output. The Shift-Clk1 and Clear signals are part of the control signals 124 from the DBD controller 120 of FIG. 1. The Clear signal can be activated by the DBD controller 120 to clear fire data from the fire data flip-flops 404. In other examples, the Clear signal can be omitted if the DBD controller 120 loads all flip-flops 404 before any activation.

In some examples, the fire data flip-flop 404 stores one bit of data, which when set to "1" enables activation of a fluidic actuator of primitive n, and when set to "0" disables activation of a fluidic actuator in primitive n.

In other examples, the storage element 404 can be implemented with a different type of storage.

Although not shown, the fluid dispensing device 102 can include multiple levels of memory, including a higher-level memory and lower-level memory. The fire data to the storage element 404 is provided from the lower-level memory. Fire data in the higher-level memory can be loaded into the lower-level memory. Also, the fire data in the higher-level memory can be shifted down a shift chain of the higher-level memory elements as a clock (e.g., Shift-Clk1 or a different clock) cycles between active and inactive states. In other examples, multiple levels of memory to store fire data are not employed.

In the ensuing discussion, it is assumed that an active value of a signal or circuit node is logic "1", and that an inactive value of a signal or circuit node is logic "0". However, in different implements, an active value can correspond to logic "0", while an inactive value can correspond to logic "1".

In each activation interval (e.g., an FPG), fire data is loaded into the storage element 404 for an individual fluidic actuator of primitive n. In the FPG arrangement, fire data is loaded on a per-primitive basis. Although primitive n includes multiple fluidic actuators (e.g., 8 fluidic actuators), the storage element 404 for primitive n stores the fire data for just one fluidic actuator, i.e., the fluidic actuator that is to be controlled for activation in the current FPG. New fire data is loaded into the storage element 404 for primitive n on each successive FPG.

The decoder portion 402 for primitive n also includes another storage element 406 to store DBD select data, which can be used to select whether or not a fluidic actuator of primitive n is to be subject to a DBD measurement. The DBD select data can be provided by the system controller 110 or by the DBD controller 120.

In some examples, the storage element 406 can be implemented as a flip-flop (referred to as "DBD select data flip-flop"), which has a D input to receive the DBD select data, a clock input to receive Shift-Clk2 (which is part of the control signals 124 from the DBD controller 120 of FIG. 1), and a C input to receive a Clear signal. The DBD select data flip-flop 406 has a Q output. In other examples, the Clear signal can be omitted if the DBD controller 120 loads all flip-flops 406 before any activation.

In the FPG arrangement, a DBD select data for an individual fluidic actuator is loaded on a per-primitive basis, similar to the loading of the fire data. Thus, for each primitive, there is just one DBD select data flip-flop 406. In some examples, the DBD select data is shifted along a series of DBD select data flip-flops 406 by the cycling of Shift-Clk2.

In the FCB arrangement, individual fire data storage elements 404 and DBD select data storage elements 406 are provided for each individual fluidic actuator, so that the fire data and the DBD select data can be loaded on a per-fluidic actuator basis.

More generally, a value stored by the storage element 406 is an example of a sense measurement indicator that can be set to a value specifying that sense measurement is to be performed for a given primitive (FPG arrangement) or a given individual fluidic actuator (FCB arrangement).

The decoder portion 402 includes a DBD activate control logic 408 and a normal activate control logic 410. The DBD activate control logic 408 controls the activation of a fluidic actuator of primitive n that is to be subjected to a DBD measurement. The normal activate control logic 410 controls activation of a fluidic actuator of primitive n for the fluidic actuator that is not subjected to DBD measurement.

The DBD activate control logic 408 includes an AND gate 412 that receives as inputs the output of the storage element 404 and the output of the storage element 406. If both the fire data and the DBD select data are set to an active value (e.g., "1"), then the AND gate 412 outputs an active value that indicates that the corresponding fluidic actuator of primitive n is to be subjected to a DBD measurement. The output of the AND gate 412 is stored into a storage element 414 (e.g., implemented with a flip-flop) upon activation of a DBD Address Strobe provided to the clock input of the flip-flop 414. The output of the AND gate 412 being active indicates that the fluidic actuator selected by a current address (within primitive n) is scheduled to be activated based on the fluid control data 114, and that the primitive is selected for measurement.

The DBD Address Strobe is pulsed active for an address that selects a fluidic actuator that is to be subjected to a DBD measurement. The DBD Address Strobe is part of the control signals 124 provided by the DBD controller 120 of FIG. 1. More generally, a "sense address strobe" is pulsed active for an address that selects a fluidic actuator that is to be subjected to a sense measurement.

The flip-flop 414 is referred to as a DBD control flip-flop, and has a D input that receives the output of the AND gate 412, a clock input that receives the DBD Address Strobe, a C input that receives a Clear Delay Fire signal (also part of the control signals 124 from the DBD controller 120 of FIG. 1), and a Q output. The DBD control flip-flop 414 captures the state of the output of the AND gate 412 such that activation of the corresponding fluidic actuator that is to be subject to DBD measurement can be performed at the appropriate time (i.e., in the DBD FPG that is time shifted from the scheduled normal FPG). Effectively, the DBD control flip-flop 414 is set to an active value if a fluidic actuator in primitive n is selected for activation on the current address, and this fluidic actuator is selected for DBD measurement.

The Q output of the DBD control flip-flop 414 is provided to one input of an AND gate 416, and the other input of the AND gate 416 receives a DBD FPG Strobe. The DBD FPG Strobe is pulsed active during the DBD FPG depicted in FIG. 3. The DBD FPG Strobe is part of the control signals 124 provided by the DBD controller 120 of FIG. 1.

If both the inputs of the AND gate 416 are active (e.g., "1"), then the AND gate 416 outputs an active value to an input of an OR gate 418. Effectively, the AND gate 416 outputs an active value if the selected fluidic actuator (for the current address) is to be subjected to DBD measurement.

The other input of the OR gate 418 receives the output of the normal activate control logic 410. The OR gate 418 outputs an active value in response to either the DBD activate control logic 408 outputting an active value or the normal activate control logic 410 outputting an active value.

The output of the OR gate 418 is referred to as Qualified Fire Data, which is provided to inputs of fire AND gates 420-0, 420-1, . . . , 420-7, assuming an example where each primitive includes 8 fluidic actuators.

In the normal activate control logic 410, a NAND gate 422 receives as inputs the DBD Address Strobe and the Q output of the DBD select data flip-flop 406.

The DBD Address Strobe is pulsed active for an address that selects a fluidic actuator that is to be subjected to a DBD measurement. Thus, if the DBD select data is set to an active value, and the DBD Address Strobe is pulsed active, the NAND gate 422 outputs an inactive value (e.g., "0"), which disables an AND gate 424 of the normal activate control logic 410 from activating its output. As a result, if a fluidic actuator of primitive n selected by a current address is to be subject to DBD measurement, the normal activate control logic 410 suppresses the activation of the fluidic actuator during the normal FPG, which allows the activation of the fluidic actuator to be activated in the DBD FPG by the DBD activate control logic 408.

On the other hand, if the DBD Select Data is set to an inactive value, or the DBD Address Strobe is not set to an active value, then the NAND gate 422 outputs an active value, which allows the AND gate 424 to output an active value if the fire data flip-flop 404 storing the fire data has an active value and the DBD FPG Strobe is not active, as detected by another input of the AND gate 424 through an inverter 426.

The AND gate 424 outputting an active value enables the activation of the fluidic actuator selected by the current address in a normal FPG.

The fire AND gates 420-0 to 420-7 also receive a Fire Pulse and outputs of respective address decoders 430-0 to 430-7. The Fire Pulse is generated by the system controller 110 or the DBD controller 120 or another controller (whether as part of the fluid dispensing device 102 or off the fluid dispensing device 102), and controls when fluidic actuators are activated. The pulse width of the Fire Pulse also may control an amount of energy provided to an activated fluidic actuator.

Each address decoder **430-*i* (i=0 to 7) receives address signals, ADDR[m:0] (an example of 130 in FIG. 1), where m≥1 and depends on the number of fluidic actuators in each primitive. For example, if there are 8 fluidic actuators per primitive, then m≥2. In some examples, the address decoder 430-0 outputs an active value if the address signals ADDR[2:0] have value 000 (referred to as "A0"), the address decoder 430-1 outputs an active value if the address signals ADDR[2:0] have value 001 (referred to as "A1"), address decoder 430-2 outputs an active value if the address signals ADDR[2:0] have value 010 (referred to as "A2**"), and so forth.

If all inputs of a fire AND gate **420-*i* (i=0 to 7) are set active, then the fire AND gate 420-*i*** activates its output Fire Actuator i signal, which is an activation signal to activate a corresponding fluidic actuator i of primitive n. If the Fire Actuator i signal is inactive, then the corresponding fluidic actuator i of primitive n remains inactive.

In operation, to control activation of fluidic actuators of each primitive, the system controller 110 provides addresses A0 to A7 in corresponding normal FPGs in a given sequence, such as the sequence of FPGs of column group CG1 shown in FIG. 3. If a given normal FPG x (having a corresponding given address Ax) is for a given fluidic actuator x that is selected for DBD measurement, then the DBD Address Strobe is activated, so that activation of the given fluidic actuator x in the given normal FPG x is suppressed in the normal activate control logic 410.

Once the sequence of normal FPGs for respective addresses A0 to A7 have been processed, the DBD controller 120 activates the DBD FPG Strobe for the DBD FPG. The DBD controller 120 also sets the address of the DBD FPG to the address Ax (which is the address of fluidic actuator x that has been selected for DBD measurement). Upon the activation of the Fire Pulse, the fire AND gate **420-*x*** activates Fire Actuator x to activate the fluidic actuator x in the DBD FPG.

Figure 5:
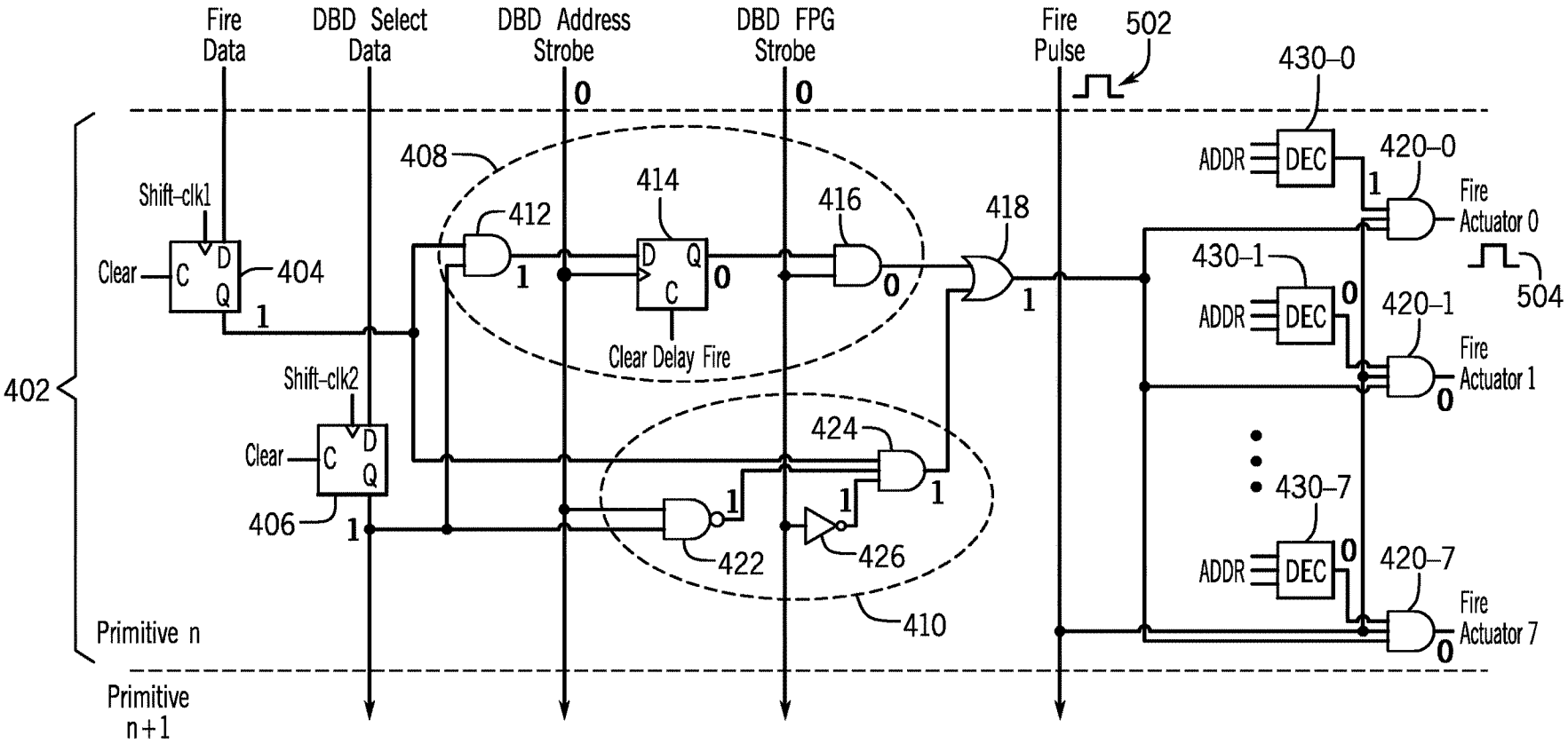
FIGS. 5-7 are schematic diagrams of a decoder that show states of various logic gates according to various examples.

FIG. 5 shows an example where fluidic actuator 0 (selected by address A0 in normal FPG 0) is activated in a normal FPG—i.e., fluidic actuator 0 is not selected for DBD measurement.

The fire data flip-flop 404 is set active ("1"), and the DBD select data flip-flop 406 is set active ("1"). However, because fluidic actuator 0 is not selected for DBD measurement, the DBD Address Strobe is inactive ("0"). As a result, the DBD control flip-flop 414 stores an inactive value ("0") since the DBD Address Strobe is inactive. The inactive value of the output of the DBD control flip-flop 414 causes the AND gate 416 to output an inactive value ("0"), which means that the DBD activate control logic 408 does not activate fluidic actuator 0 for DBD measurement.

However, the normal activate control logic 410 provides an active value ("1") to the OR gate 418. Since the DBD Address Strobe is inactive, the NAND gate 422 outputs an active value ("1") to an input of the AND gate 424. Also, because fluidic actuator 0 is to be activated in normal FPG 0, the DBD FPG Strobe is inactive, and thus the output of the inverter 426 has an active value ("1") provided to an input of the AND gate 424. The fire data flip-flop 404 also outputs an active value. As a result, the AND gate 424 outputs an active value ("1"), which causes the OR gate 418 to output an active value ("1") that is provided to an input of each of the fire AND gates 420-0, 420-1, . . . , 420-7. Upon active pulsing of the Fire Pulse (502), the fire AND gate 420-0 outputs a corresponding pulse 504 if the address ADDR[2:0] detected by the address decoder 430-0 is A0.

Figure 6:
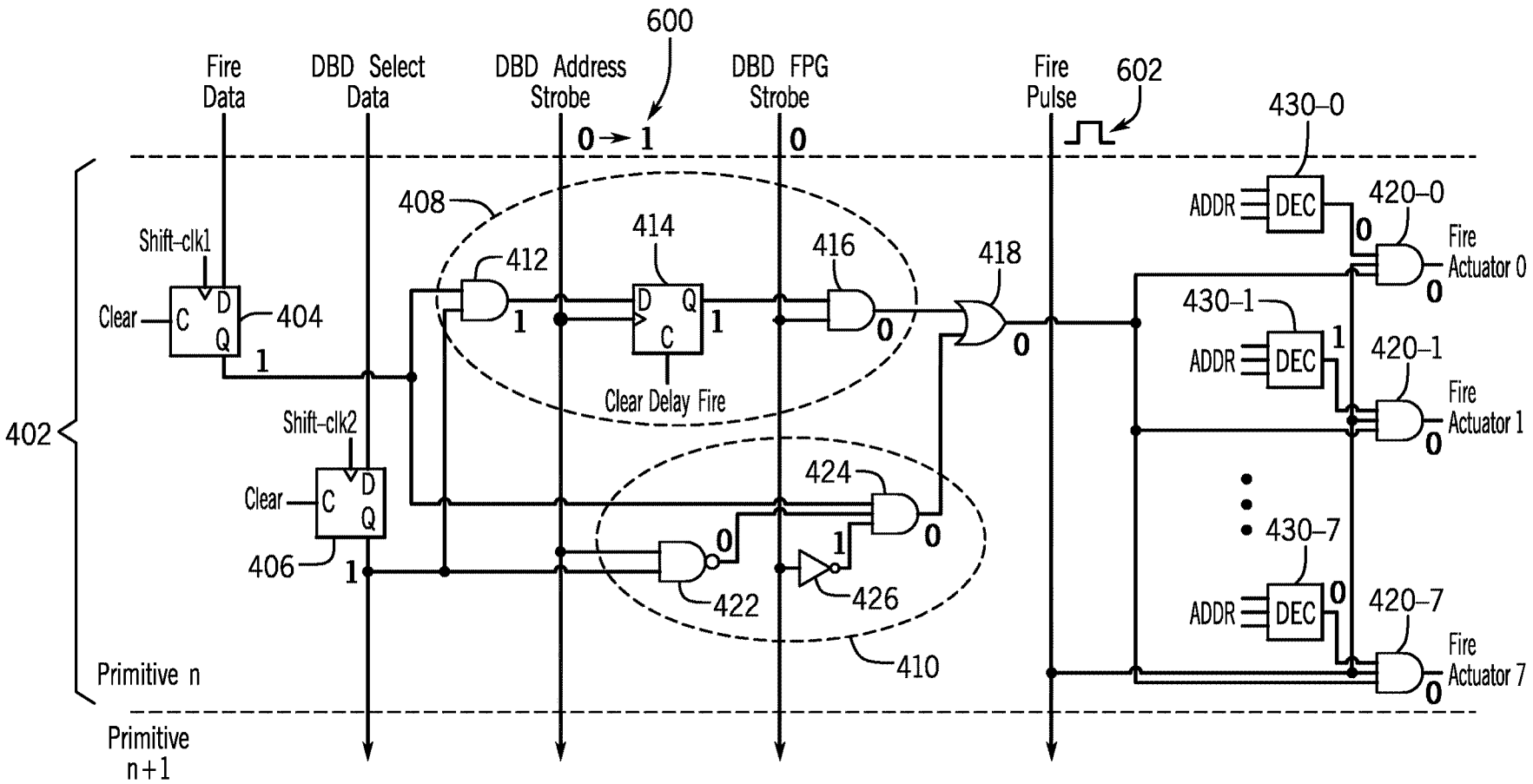

Within the same primitive n, it is assumed that fluidic actuator 1 is the fluidic actuator that is scheduled for activation by address 001, and that has been selected for DBD measurement. FIG. 6 shows example states of the various circuits of the decoder portion 402 in normal FPG 1 (which follows normal FPG 0 in FIG. 5). In FIG. 6, the address provided is A1, and as a result, the DBD Address Strobe has transitioned from "0" to "1" (as indicated by 600).

In response to this transition of the DBD Address Strobe, the DBD control flip-flop 414 loads the active value of the output of the AND gate 412 (because both the fire data flip-flop 404 and the DBD select data flip-flop 406 store an active value), and the DBD control flip-flop 414 outputs an active value ("1").

With both the DBD Address Strobe and the DBD select data flip-flop 406 being active, the NAND gate 422 in the normal activate control logic 410 outputs an inactive value ("0"), which causes the AND gate 424 to output an inactive value ("0"). As a result, activation of the fluidic actuator 1 is suppressed in the normal activate control logic 410 during normal FPG 1 for address A1.

While in normal FPG 1, the DBD FPG Strobe remains at the inactive value ("0"), and so the AND gate 416 of the DBD activate control logic 408 also outputs an inactive value ("0"). The OR gate 418 outputs a corresponding "0" since both its inputs are "0", so fluidic actuator 1 is not activated in normal FPG 1 corresponding to address A1 when a Fire Pulse 602 is activated. As shown in FIG. 6, all Fire Actuator i signals remain inactive.

The process continues with the remaining normal FPGs 2, 3, 4, 5, 6, and 7 (not shown), to control activation of corresponding fluidic actuators 2, 3, 4, 5, 6, and 7 depending on whether or not the fire data is set in the respective normal FPGs 2, 3, 4, 5, 6, and 7.

Figure 7:
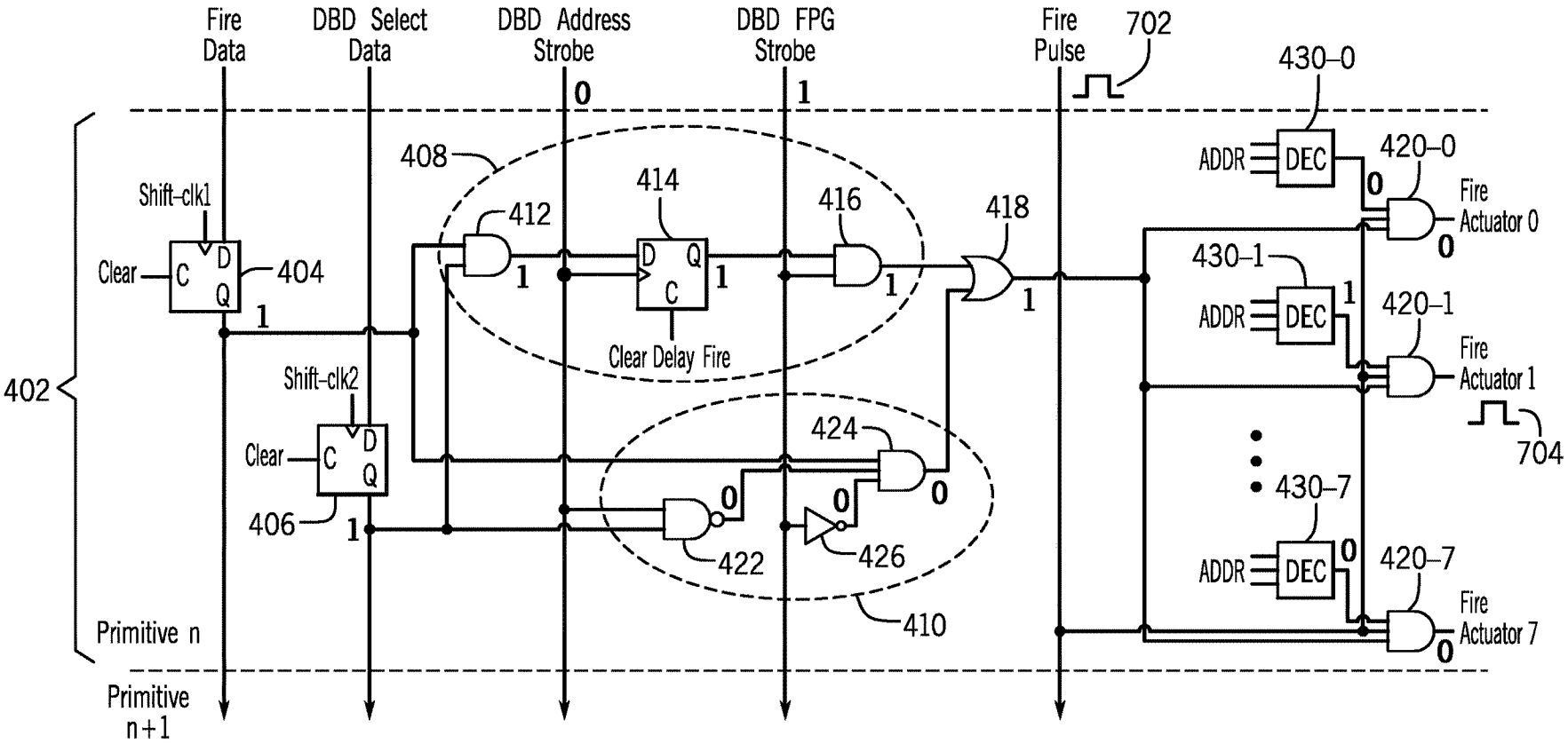

FIG. 7 shows example states of the various circuits of the decoder portion 402 during the DBD FPG (after the sequence of normal FPGs). In FIG. 7, the DBD Address Strobe has transitioned back to an inactive value ("0"), and the DBD FPG Strobe has transitioned to an active value ("1") because the fluid dispensing device 102 is currently in the DBD FPG.

During the DBD FPG, the AND gate 424 of the normal activate control logic 410 outputs an inactive value.

However, in the DBD activate control logic 408, the DBD control flip-flop 414 continues to store an active value ("1"), and the AND gate 416 of the DBD activate control logic 408 outputs an active value ("1") once the DBD FPG Strobe is activated. As a result, the OR gate 418 outputs an active value ("1"), which is provided to the fire AND gates 420-0 to 420-7.

In the DBD FPG, address A1 (the address of fluidic actuator 1 that is selected for DBD measurement and for which activation was suppressed in normal FPG 1 in FIG. 6) is again supplied (such as by the DBD controller 120). As a result, the address decoder 430-1 outputs an active value, and once a Fire Pulse 702 is activated, the fire AND gate 420-1 activates its Fire Actuator 1 signal to activate fluidic actuator 1 for DBD measurement.

A measurement made by the sensor for fluidic actuator 1 activated in the DBD FPG is supplied as the DBD measurement signal 107 (FIG. 1) to the DBD circuit 106.

Figure 8:
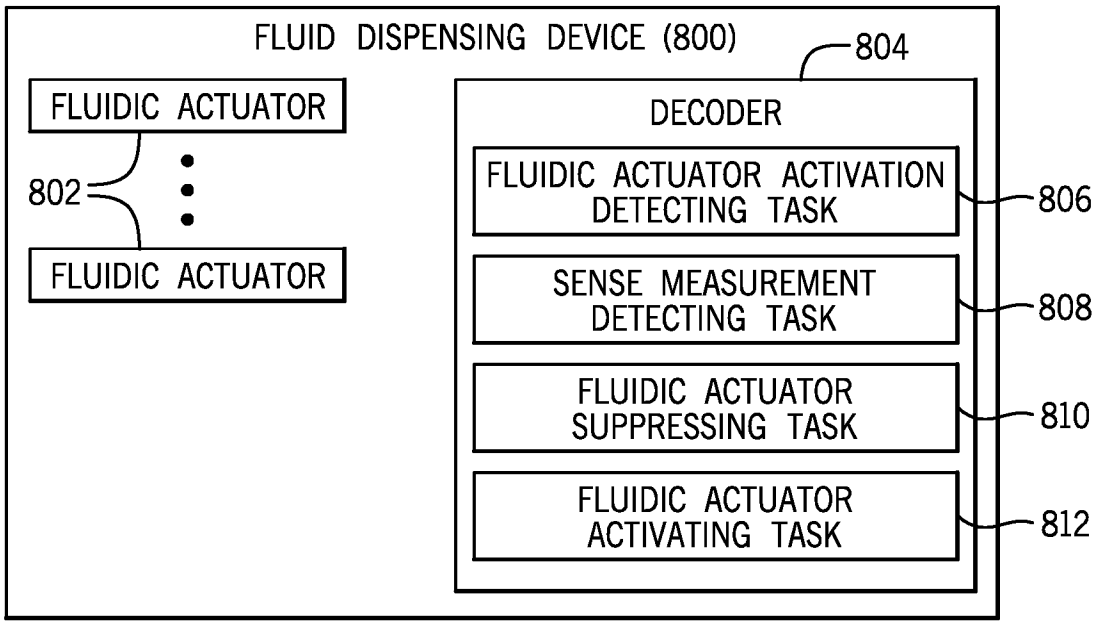
FIG. 8 is a block diagram of a fluid dispensing device according to additional examples.

FIG. 8 is a block diagram of a fluid dispensing device 800 that includes a plurality of fluidic actuators 802 and a decoder 804. The decoder 804 is configured (either using hardware circuitry such as shown in FIG. 4 or using machine-readable instructions) to perform various tasks. The tasks include a fluidic actuator activation detecting task 806 to detect that a first fluidic actuator is to be activated, and a sense measurement detecting task 808 to detect that a sense measurement is to be performed. In response to detecting that the first fluidic actuator is to be activated and the sense measurement is to be performed, the tasks include a fluidic actuator suppressing task 810 to suppress activation of the first fluidic actuator at a first time, and a fluidic actuator activating task 812 to activate the first fluidic actuator at a second time corresponding to a sense measurement interval to perform the sense measurement of the first fluidic actuator.

Figure 9:
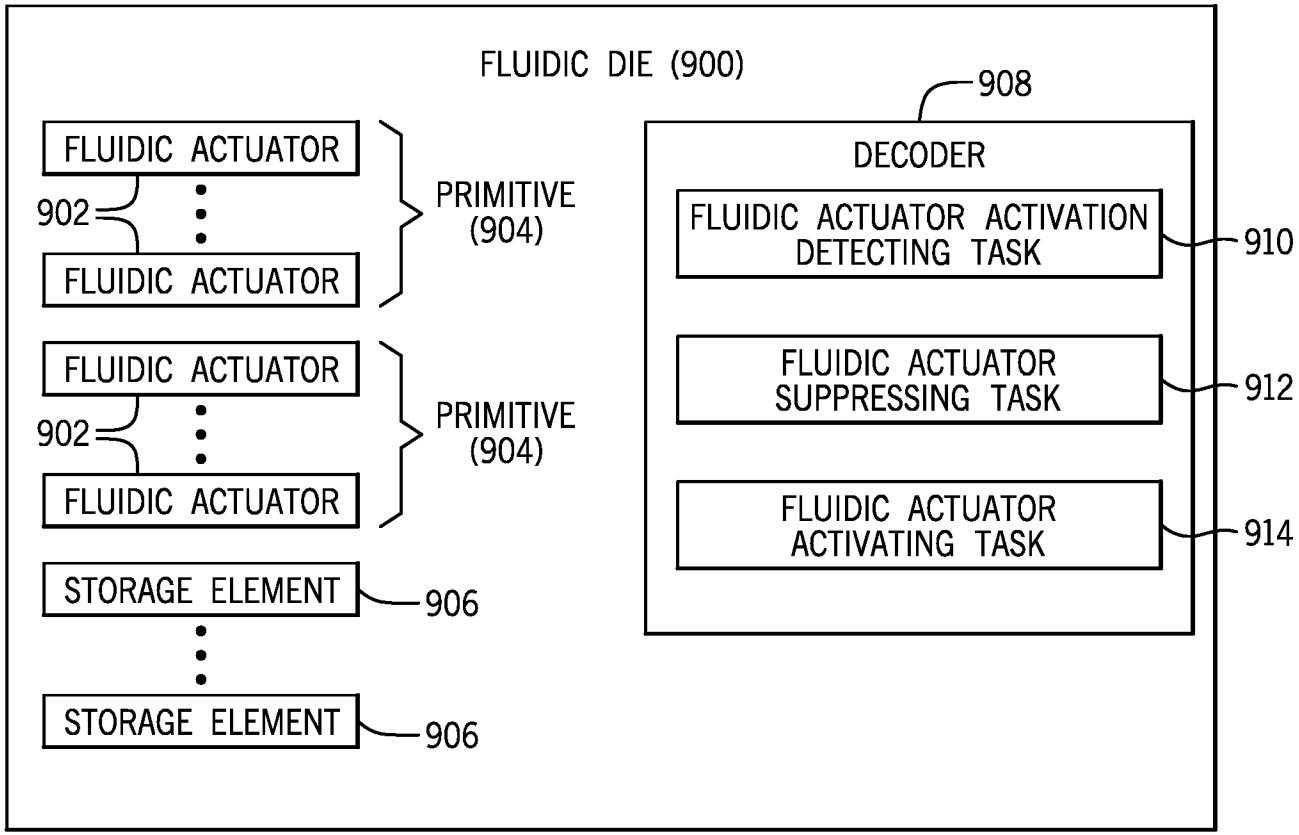
FIG. 9 is a block diagram of a fluidic die according to yet further examples.

FIG. 9 is a block diagram of a fluidic die 900 including a plurality of fluidic actuators 902 arranged as primitives 904 of fluidic actuators. A plurality of storage elements 906 store sense measurement indicators to indicate whether or not respective fluidic actuators or primitives are to be subject to a sense measurement. A decoder 908 is configured to perform various tasks. The tasks include a fluidic actuator activation detecting task 910 to detect that a first fluidic actuator is to be activated. In response to detecting that the first fluidic actuator is to be activated and a sense measurement indicator in a first storage element associated with the first fluidic actuator being set active indicating that a sense measurement is to be performed, the tasks include a fluidic actuator suppressing task 912 to suppress activation of the first fluidic actuator at a first time, and a fluidic actuator activating task 914 to activate the first fluidic actuator at a second time corresponding to a sense measurement interval to perform the sense measurement of the first fluidic actuator.

In examples where the system controller 110, DBD controller 120, or the decoder 122 (FIG. 1) is implemented as a combination of a hardware processing circuit and machine-readable instructions, the controller or decoder can include a processor and a non-transitory machine-readable or computer-readable storage medium storing machine-readable instructions executable on the processor to perform respective tasks.

A processor can include a microprocessor, a core of a multi-core microprocessor, a microcontroller, a programmable integrated circuit, a programmable gate array, or another hardware processing circuit. Machine-readable instructions executable on a processor can refer to the instructions executable on a single processor or the instructions executable on multiple processors.

The storage medium can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site (e.g., a cloud) from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid dispensing device comprising:

a plurality of fluidic actuators; and a decoder to:

detect that a first fluidic actuator is to be activated;

detect that a sense measurement is to be performed; and in response to detecting that the first fluidic actuator is to be activated and the sense measurement is to be performed:

suppress activation of the first fluidic actuator at a first time, and activate the first fluidic actuator at a second time corresponding to a sense measurement interval to perform the sense measurement of the first fluidic actuator.

2. The fluid dispensing device of claim 1, wherein the detecting that the sense measurement is to be performed comprises detecting that a sense measurement indicator is set active specifying that the sense measurement is to be performed for the first fluidic actuator.

3. The fluid dispensing device of claim 1, wherein the detecting that the sense measurement is to be performed comprises detecting that a sense measurement indicator is set active specifying that the sense measurement is to be performed for a fluidic actuator of a group of fluidic actuators including the first fluidic actuator.

4. The fluid dispensing device of claim 3, wherein the group of fluidic actuators are associated with respective activation intervals associated with respective different addresses, and wherein the suppressing of the activation of the first fluidic actuator at the first time is further in response to activation of a sense address strobe indicating an activation interval associated with the first fluidic actuator.

5. The fluid dispensing device of claim 3, further comprising a storage element to store the sense measurement indicator.

6. The fluid dispensing device of claim 5, wherein the storage element is part of a series of storage elements, the series of storage elements to shift the sense measurement indicator through the series of storage elements to select a fluidic actuator on which to perform a sense measurement.

7. The fluid dispensing device of claim 3, wherein the decoder comprises a logic gate to set a sense activate indicator active in response to the sense measurement indicator being set active and a fluid control data for the first fluidic actuator being set active.

8. The fluid dispensing device of claim 7, wherein the decoder is to assert an activation signal for the first fluidic actuator in response to a signal indicating the sense measurement interval and in response to the sense activate indicator being set active and activate data for the first fluidic actuator being set active.

9. The fluid dispensing device of claim 8, wherein the decoder is to assert the activation signal for the first fluidic actuator further in response to a fire pulse.

10. The fluid dispensing device of claim 3, wherein the decoder comprises a logic gate to:

enable activation of the first fluidic actuator at the first time in response to the sense measurement indicator being set inactive and an activate data for the first fluidic actuator being set active; and suppress activation of the first fluidic actuator at the first time in response to the sense measurement indicator being set active and a sense address strobe for the first fluidic actuator being set active, even if the activate data for the first fluidic actuator is set active.

11. A fluidic die comprising:

a plurality of fluidic actuators arranged as primitives of fluidic actuators;

a plurality of storage elements to store sense measurement indicators to indicate whether or not respective fluidic actuators or primitives are to be subject to a sense measurement; and a decoder to:

detect that a first fluidic actuator is to be activated; and in response to detecting that the first fluidic actuator is to be activated and a sense measurement indicator in a first storage element associated with the first fluidic actuator being set active indicating that a sense measurement is to be performed:

suppress activation of the first fluidic actuator at a first time, and activate the first fluidic actuator at a second time corresponding to a sense measurement interval to perform the sense measurement of the first fluidic actuator.

12. The fluidic die of claim 11, wherein activations of fluidic actuators of a primitive are controlled by respective different addresses.

13. The fluidic die of claim 11, wherein the decoder comprises:

a first logic gate to suppress the activation of the first fluidic actuator in response to the sense measurement indicator in the first storage element being set active, even if activate data for the first fluidic actuator is set active;

a second logic gate to activate the first fluidic actuator at the second time in response to the sense measurement indicator in the first storage element being set active, and the activate data for the first fluidic actuator being set active.

14. A method of a fluid dispensing device, comprising:

detecting, by a decoder of the fluid dispensing device, that a first fluidic actuator is to be activated;

detecting, by the decoder, that a sense measurement is to be performed; and in response to detecting that the first fluidic actuator is to be activated and the sense measurement is to be performed:

suppressing activation of the first fluidic actuator at a first time, and activating the first fluidic actuator at a second time corresponding to a sense measurement interval to perform the sense measurement of the first fluidic actuator.

15. The method of claim 14, wherein detecting that the sense measurement is to be performed is based on a sense measurement indicator set active to indicate that the sense measurement is to be performed for a fluidic actuator of a group of fluidic actuators including the first fluidic actuator, the group of fluidic actuators being associated with respective activation intervals associated with respective different addresses, and wherein the suppressing of the activation of the first fluidic actuator at the first time is further in response to activation of a sense address strobe indicating an activation interval associated with the first fluidic actuator.

* * * * *